US007644775B2

(12) United States Patent
Sundholm

(10) Patent No.: US 7,644,775 B2
(45) Date of Patent: Jan. 12, 2010

(54) FIRE-FIGHTING INSTALLATION AND DRIVE SOURCE OF FIRE-FIGHTING INSTALLATION

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 1007 days.

(21) Appl. No.: 10/688,859

(22) Filed: Oct. 17, 2003

(65) Prior Publication Data

US 2004/0123990 A1 Jul. 1, 2004

Related U.S. Application Data

(63) Continuation of application No. PCT/FI02/00382, filed on May 6, 2002.

(30) Foreign Application Priority Data

May 7, 2001 (FI) ..... 20010950

(51) Int. Cl.
*A62C 35/00* (2006.01)

(52) U.S. Cl. ..... 169/13; 169/16; 169/17; 239/68; 239/74

(58) Field of Classification Search ..... 169/13, 169/16, 17; 239/68, 74
See application file for complete search history.

(56) References Cited

U.S. PATENT DOCUMENTS 1,633,108 A * 6/1927 Knight ..... 169/13
5,099,925 A 3/1992 Glidden et al.
5,113,944 A 5/1992 Nakagawa et al.
5,117,916 A * 6/1992 Ohta et al. ..... 169/37
5,433,383 A 7/1995 Sundholm
5,845,714 A 12/1998 Sundholm
5,927,406 A 7/1999 Kadoche
5,944,113 A 8/1999 Sundholm

FOREIGN PATENT DOCUMENTS

| | | |
|---|---|---|
| DE | 10010881 A1 | 9/2001 |
| EP | 0 873 766 A2 | 10/1998 |
| WO | 92/20454 | 11/1992 |
| WO | 95/02433 | 1/1995 |
| WO | 96/08291 | 3/1996 |

* cited by examiner

*Primary Examiner*—Christopher S Kim
(74) *Attorney, Agent, or Firm*—Ladas & Parry LLP

(57) ABSTRACT

The invention relates to fire-fighting installation comprising a drive source for feeding medium into at least one heat releasing spray head (4), the drive source comprising a pump unit (5) for feeding liquid into said spray head through a supply line (3) which is filled with gas to a standby pressure, a gas source (9) for maintaining the standby pressure, and a sensor (2) arranged to provide a signal for starting the pump unit in response to a change occurring in the state of the medium in the supply line. In order to rapidly start the pump unit (5) of the drive source as a result of a minor flow occurring in the supply line (3) and in order for the fire-fighting installation to be applicable to be used at low temperatures, the sensor is a flow transducer (2) arranged to provide a signal to the pump unit (5), if the flow of gas in said portion of the supply line exceeds a certain predetermined value.

10 Claims, 1 Drawing Sheet

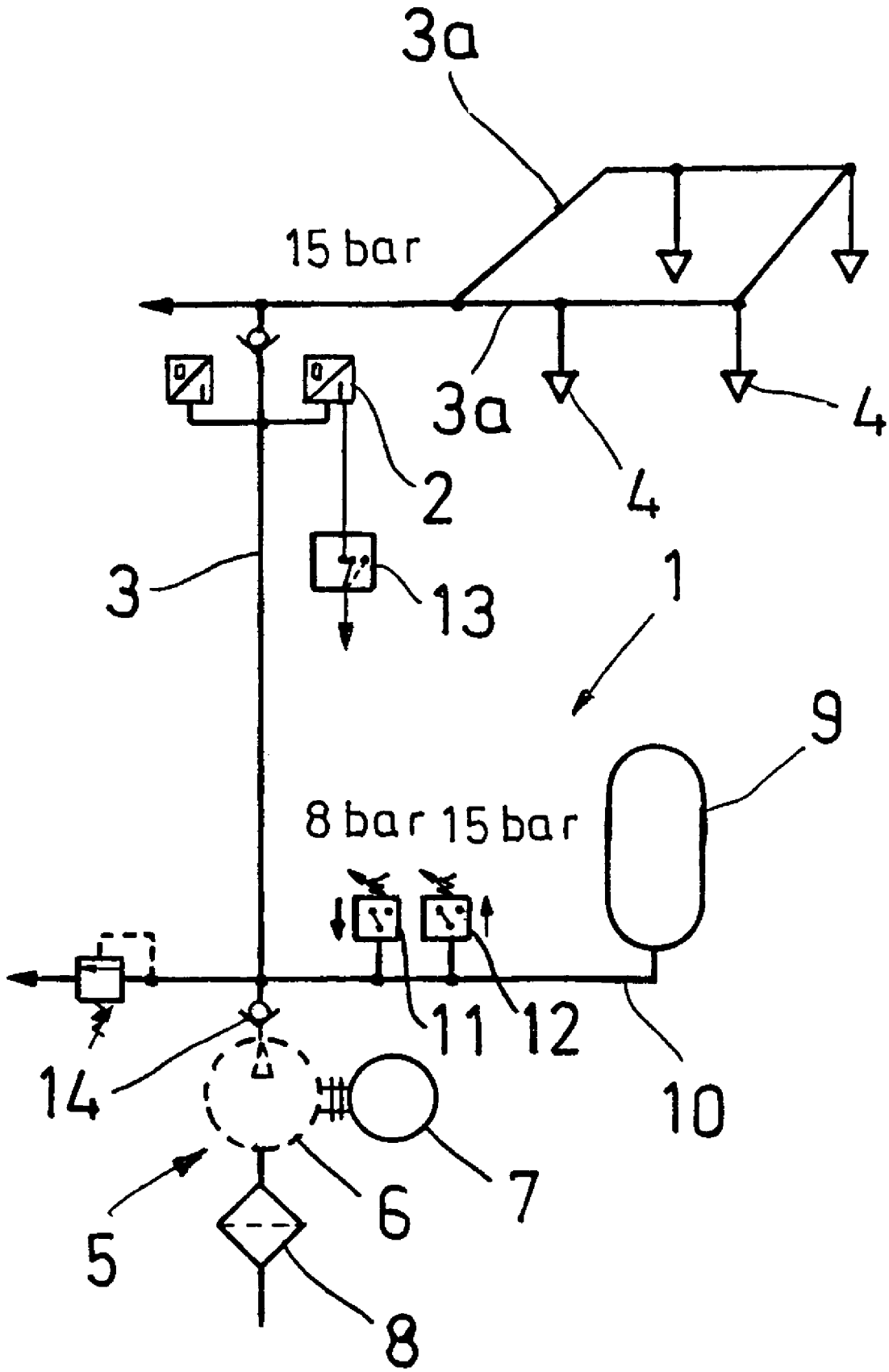
3a
15 bar
3a
4
4
2
3
13
1
9
8 bar
15 bar
11
12
14
10
7
6
5
8

FIRE-FIGHTING INSTALLATION AND DRIVE SOURCE OF FIRE-FIGHTING INSTALLATION

This application is a continuation of application number PCT/FI02/00382 filed on May 6, 2002, which designated the U.S., claims the benefit thereof and incorporates the same by reference.

BACKGROUND OF THE INVENTION

The invention relates to a fire-fighting installation comprising a drive source for feeding medium into at least one spray head of the fire-fighting installation, said at least one spray head releasing by impact of heat, the drive source comprising a pump unit for feeding liquid into said at least one spray head through a supply line, a portion of the supply line restricted to the spray head being filled with gas provided with a standby pressure, a gas source for maintaining the standby pressure of the supply line and a sensor arranged to provide a signal for starting the pump unit in response to a change occurring in the state of the medium in the supply line.

The invention also relates to a drive source of a fire-fighting installation comprising a pump unit for feeding liquid into the fire fighting installation.

What are known as preaction fire extinguishing installations comprise a drive source like the one mentioned above. In such a case, the fire extinguishing installation comprises a sensor in the form of a pressure sensor for starting the pump unit. The pressure sensor reacts to the decline of the gas pressure in the supply line and starts the pump unit for feeding liquid into the sprinklers of the fire extinguishing installation. In a typical sprinkler system the dimensioning flows of liquid are extensive, whereby the pipe volumes and the discharge openings of the liquid are also large. In a dry (mounted) system the gas volumes are therefore also large and when the system releases, the gas discharges and correspondingly the pressure drops rapidly. The pressure sensor rapidly starts the pump unit and liquid flows from the sprinklers during an acceptable time, generally 30 seconds, from the release. This is important in order to be able to efficiently and rapidly extinguish fires. Dry-mountable fire extinguishing installations are also previously known in the art that are dimensioned—for different reasons—in such a manner that the liquid starts flowing 60 to 90 seconds from releasing the spray head. Such fire extinguishing installations are not suitable to be mounted for all purposes owing to the reduced speed thereof.

Prior art fire extinguishing installations and the drive sources thereof operate satisfactorily when the pressure is rapidly reduced in the supply line as a result of the extensive flow started in the supply line. In fire extinguishing installations the flow generally becomes large, when they comprise conventional spray heads conveying a rain-like or liquid jet flow, in other words spray heads provided with nozzles comprising large openings. Then again, particularly mist-type fire extinguishing installations including spray heads conveying a mist-like flow and being able to efficiently extinguish/fight fires by spraying mist use a minor amount of liquid. In these installations, the flow is much smaller and the pressure is not reduced rapidly enough in the supply line in order for the pressure sensor to react to the reduction of pressure in an acceptable time.

BRIEF DESCRIPTION OF THE INVENTION

It is an object of the invention to provide a new fire-fighting installation in which the feed of medium may be rapidly initiated from the pump unit to the spray heads of the fire-fighting installation even if the pressure in the supply line does not decrease rapidly, the fire-fighting installation also being able to operate at low temperatures even though the medium is water and liable to freeze. The advantages of the fire-fighting installation are particularly noticeable in a mist-type fire-fighting installation, but the fire-fighting installation of the invention need not be of such a type. The present invention provides a fire-fighting installation comprising a drive source for feeding medium into at least one spray head of the fire-fighting installation, said at least one spray head releasing by impact of heat, the drive source comprising a pump unit for feeding liquid into said at least one spray head releasing by impact of heat through a supply line, a portion of the supply line restricted to the spray head being filled with gas provided with a standby pressure, a gas source for maintaining the standby pressure of the supply line and a sensor arranged to provide a signal for starting the pump unit in response to a change occurring in the state of the medium in the supply line, wherein the sensor is a flow transducer arranged to provide a signal to the pump unit, if the flow of gas in the portion of the supply line exceeds a certain predetermined value. Preferably the spray head is arranged to spray mist, in which case the advantages of mist are achieved in fire fighting.

The preferred embodiments of the fire-fighting installation are disclosed in the accompanying claims.

The present invention provides a drive source of a fire-fighting installation comprising a pump unit for feeding liquid into the fire-fighting installation through a supply line, a portion of the supply line restricted to the fire-fighting installation being filled with gas having a standby pressure, a gas source for maintaining the standby pressure of the supply line and a sensor arranged to provide a signal to start the pump unit in response to a change occurring in the state of the medium in the supply line, wherein the sensor is a flow transducer arranged to provide a signal to the pump unit if the flow of gas in said portion of the supply line exceeds a certain predetermined value.

A further invention is the use of the fire-fighting installation of the invention at low temperatures, for instance when fighting attic and other fires occurring in wooden churches.

The major advantage of the fire-fighting installation of the invention and the drive source of the fire-fighting installation is a rapid and automatic start of the pump unit thereof even if the flow in the supply line is scarce. A rapid start is of vital importance when fighting fires. The fire-fighting installation and the drive source are applicable to be used at low temperatures, where water may freeze and thus prevent the fire-fighting installation from functioning. An example of such an application is the fire-fighting installation of wooden churches. The invention does not employ antifreeze agents or other chemicals harmful to the environment; instead these are replaced with an incombustible gas.

BRIEF DESCRIPTION OF THE DRAWINGS

In the following the invention will be described in greater detail by means of a preferred embodiment with reference to the accompanying drawing, which illustrates the fire-fighting installation and the drive source associated therewith.

DETAILED DESCRIPTION OF THE INVENTION

The Figure shows a fire-fighting installation comprising a drive source generally indicated with reference numeral 1 and a flow transducer 2 connected thereto. The flow transducer 2 is connected to a supply line 3 starting from the drive source, and the supply line feeds extinguishing medium to spray heads 4. The spray heads 4 are of a type arranged to spray mist, when aqueous liquid is fed thereto, whereby they comprise small-sized nozzles, i.e. nozzles with small openings.

Reference numeral 5 shows the pump unit, which comprises a pump 6 that preferably is a high-pressure pump and an electric motor 7 using the pump. The primary side of the pump 6 is connected to the extinguishing medium source (not shown) that is for instance a pipeline network or a water tank. A filter 8 is fitted between the pump 6 and the extinguishing medium source (not shown).

The supply line 3 also including supply lines 3*a* leading to the spray heads 4 are filled with gas, for example with incombustible gas such as nitrogen or air. The gas ensures that the supply lines 3, 3*a* do not freeze. Instead of filling the entire supply line 3 including the supply lines 3*a* with gas, it is possible to fill only the portion of the supply line that is close to the spray heads 4, i.e. the portion of the supply line restricted to the spray heads, with gas. In the latter case, the end of the supply line that is close to the pump unit 5 may include liquid, in which case the portion of the supply line that includes gas is naturally separated from the portion of the supply line that includes liquid, so as not to mix the gas and the liquid, cf. the back valve 14 in the Figure.

Reference numeral 9 indicates a pressure accumulator that includes nitrogen gas, air and other incombustible gases. The delivery pressure of the pressure accumulator 9 is for instance 100 bar. Two pressure switches 11 and 12 are connected to the output 10 of the pressure accumulator 9. The pressure switches 11, 12 can alternatively be directly connected to the supply line 3. The idea of the pressure accumulator 9 is to maintain a certain gas pressure in the supply line 3, in other words a standby pressure when the pump unit 5 of the fire-fighting installation is not in use. If the standby pressure decreases with time owing to gas leaks (which practically always occur) below the standby pressure mentioned, for instance below 8 bar, the pressure accumulator 9 increases the gas pressure of the supply line 3 to the value of for example 15 bar. The flow transducer 2 is selected so as not to provide the pump unit 5 with a signal as a result of the flow caused by the minor gas leaks. Instead what is required for sending a signal to the pump unit is that the flow transducer notes a flow that exceeds a certain predetermined minimum value, which in practice is very small.

The pressure switch 11 controls the operation of the pressure accumulator 9 so that the accumulator feeds gas into the supply line 3, if the pressure therein goes below the value of the standby pressure (for example 8 bar), or another particular predetermined value. The pressure switch 12 prevents the gas pressure from rising above 15 bar or another particular predetermined value. If the pressure in the supply line 3 rises above the 15 bar value (owing to the fact that the pump unit 5 feeds water into the supply line), the accumulator 9 does not feed gas into the supply line 3.

In the following, the function of the fire extinguishing installation in the Figure is explained.

In the event of fire, at least one of the spray heads 4 releases. The spray head is typically a sprinkler, i.e. the spray head 4 is provided with a means reacting to temperature, i.e. the impact of heat. When the spray head 4 releases, it starts spraying gas. The flow transducer 2 immediately detects the flow of gas and sends a starting signal to the pump unit 5. It should be noted that a pressure transducer is not able to start the pump unit 5, since the pressure in the supply line 3 decreases too slowly. The pump unit 5 starts feeding water into the spray head 4 in a few seconds, typically in approximately 30 seconds at the most, starting from the time the flow transducer 2 has detected the gas flow. The water is sprayed from the spray head 4 as mist-like liquid comprising small droplets. The spray heads 4 with small nozzles and the use of a fairly high pressure enable to provide the mist-like liquid. The pump unit 5 forms a fairly high, for instance 20 to 100 bar, or even higher pressure to the supply line 3. As the temperature of the water to be fed from the pump unit 5 exceeds the freezing temperature of water, the flowing water will not freeze in the supply line 3 even though it is placed in an environment where the temperature is below 0 degrees Celsius.

In some rare applications the flow transducer 2 can be adjusted to operate in such a manner that it starts the pump unit 5 with a minor delay. The delay is within the range of 30 to 60 seconds and it is achieved for instance using a relay (not shown). If said time delay is associated with the operation of the flow transducer 2, the start of the drive source can if desired be prevented during the delay using a manually usable closing means 13, whereby an unnecessary start of the extinguishing installation (pump unit) is prevented.

The invention is described above by means of one example only and it is therefore pointed out that the details of the invention may differ in various ways within the scope of the attached claims. The position of the flow transducer 2 may be different than what is shown in the Figure; it may basically be located anywhere in the supply line 3 or in the system, but requires a gas connection to the supply line. A compressor can be used instead of the gas source in the form of a pressure accumulator 9. The liquid pumped by the pump unit is typically water without any additives, but in some applications additives such as anti-corrosion agents can be added to the water.

The invention claimed is:

1. In a fire-fighting installation comprising a drive source for feeding medium into at least one spray head, the at least one spray head releasing by impact of heat, and the drive source comprising a pump unit for the feeding of the medium through a supply line, the improvements wherein at least a portion of the supply line is filled with gas provided with a standby pressure, a gas source maintains the standby pressure, and a flow transducer is arranged to provide a signal to the pump unit if flow of the gas in the portion of the supply line exceeds a predetermined value.

2. A fire-fighting installation as claimed in claim 1, wherein the spray head is arranged to spray mist.

3. A fire-fighting installation as claimed in claim 1, wherein the gas source is a pressure accumulator connected to said portion of the supply line and which controlled by a first pressure switch attached to the output of the pressure accumulator is arranged to feed gas to the supply line in case the pressure of the supply line drops below a certain first value in order to maintain the standby pressure.

4. A fire-fighting installation as claimed in claim 3, wherein the pressure accumulator is controlled by a second pressure switch associated with the output of the pressure accumulator arranged before starting the pump unit to raise the pressure in the supply line at the most to a certain second value that goes below the pressure in the supply line caused by the pump unit after having started the pump unit.

5. A fire-fighting installation as claimed in claim 1, wherein the gas in the portion of the supply line and in the pressure accumulator is nitrogen gas.

6. A fire-fighting installation as claimed in claim 5, wherein said medium is water, whereby the pump unit is arranged to feed water into the supply line.

7. A fire-fighting installation as claimed in claim 1, wherein said medium is water, whereby the pump unit is arranged to feed water into the supply line.

8. A fire-fighting installation as claimed in claim 1, wherein the portion of the supply line is liable to freeze.

9. A fire-fighting installation as claimed in claim 8, wherein said medium is water, whereby the pump unit is arranged to feed water into the supply line.

10. A drive source of a fire-fighting installation comprising a pump unit for feeding liquid into the fire-fighting installation through a supply line, a portion of the supply line restricted to the fire-fighting installation being filled with gas having a standby pressure, a gas source for maintaining the standby pressure of the supply line and a sensor arranged to provide a signal to start the pump unit in response to a change occurring in the state of the medium in the supply line, wherein the sensor is a flow transducer arranged to provide a signal to the pump unit if flow of the gas in said portion of the supply line exceeds a certain predetermined value.

* * * * *